US010508570B2

(12) United States Patent
Shishido et al.

(10) Patent No.: US 10,508,570 B2
(45) Date of Patent: Dec. 17, 2019

(54) VALVE STEM SEAL

(71) Applicant: NOK CORPORATION, Tokyo (JP)

(72) Inventors: Hiroki Shishido, Fukushima (JP); Tsunehisa Onuma, Fukushima (JP)

(73) Assignee: NOK CORPORATION, Tokyo (JP)

( * ) Notice: Subject to any disclaimer, the term of this patent is extended or adjusted under 35 U.S.C. 154(b) by 252 days.

(21) Appl. No.: 15/113,066

(22) PCT Filed: Jan. 16, 2015

(86) PCT No.: PCT/JP2015/051007
§ 371 (c)(1),
(2) Date: Jul. 21, 2016

(87) PCT Pub. No.: WO2015/111505
PCT Pub. Date: Jul. 30, 2015

(65) Prior Publication Data

US 2017/0009616 A1 Jan. 12, 2017

(30) Foreign Application Priority Data

Jan. 22, 2014 (JP) ..... 2014-009396

(51) Int. Cl.
*F01L 3/08* (2006.01)

(52) U.S. Cl.
CPC ..... *F01L 3/08* (2013.01)

(58) Field of Classification Search
CPC ..... F16J 15/46; F01L 3/08
USPC ..... 277/502, 635, 636, 637, 638
See application file for complete search history.

(56) References Cited

U.S. PATENT DOCUMENTS 2,157,866 A * 5/1939 Robertson ..... F01L 3/08 277/502
2,734,758 A * 2/1956 Schanke ..... F16C 23/086 277/421
4,811,704 A 3/1989 Boehmer et al.
4,947,811 A * 8/1990 Binford ..... F01L 3/08 123/188.6

(Continued)

FOREIGN PATENT DOCUMENTS

JP S462577 Y1 1/1971
JP S473215 Y1 2/1972

(Continued)

*Primary Examiner* — Kristina R Fulton
*Assistant Examiner* — L. Susmitha Koneru
(74) *Attorney, Agent, or Firm* — Harness, Dickey & Pierce, P.L.C.

(57) ABSTRACT

A valve stem seal exhibits superior workability of mounting of a reinforcing ring to a valve stem guide and enables the reinforcing ring to be fixed to the valve stem guide in a stable manner. A reinforcing ring is mounted to a valve stem guide by fitting a cylindrical portion to the valve stem guide from a side opposite to an inward flange portion. The cylindrical portion includes a slit extending linearly in a circumferential direction and a locking protrusion that is provided on a side opposite to the inward flange portion with respect to the slit and that is to be locked by a locking recess formed in the valve stem guide. The locking protrusion is constituted by a curved portion that is gradually recessed radially inward from the side opposite to the inward flange portion with respect to the slit to a position that reaches the slit.

2 Claims, 2 Drawing Sheets

(56) References Cited

U.S. PATENT DOCUMENTS

| | | | | | |
|---|---|---|---|---|---|
| 6,148,783 | A * | 11/2000 | Hesher | F01L 3/08 | 123/188.6 |
| 6,227,548 | B1 * | 5/2001 | Netzer | F01L 3/08 | 277/502 |
| 6,230,679 | B1 * | 5/2001 | Hegernier | F01L 3/08 | 123/190.17 |
| 6,609,700 | B2 * | 8/2003 | Leimer | F01L 3/08 | 123/188.6 |
| 6,877,719 | B2 * | 4/2005 | Heinl | F01L 3/08 | 123/190.17 |
| 9,133,883 | B2 * | 9/2015 | Mori | F16D 1/116 | |

FOREIGN PATENT DOCUMENTS

| | | | |
|---|---|---|---|
| JP | S5559111 | U | 4/1980 |
| JP | H01275967 | A | 11/1989 |
| JP | H0337311 | A | 2/1991 |
| JP | 2003-343735 | A | 12/2003 |

* cited by examiner

VALVE STEM SEAL

CROSS-REFERENCE TO RELATED APPLICATIONS

This application is a National Stage of International Application No. PCT/2015/051007, filed Jan. 16, 2015(now WO 2015/111505A1), which claims priority to Japanese Application No. 2014-009396, filed Jan. 22, 2014. The entire disclosures of each of the above applications are incorporated herein by reference.

FIELD

The present disclosure relates to a valve stem seal that seals a gap between a valve stem and a valve stem guide.

BACKGROUND

An intake/exhaust valve mechanism of an internal combustion engine is provided with a valve stem seal that seals a gap between a valve stem and a valve stem guide. Generally, a valve stem seal is constituted by a reinforcing ring which is fixed to a valve stem guide and a seal main body made of an elastic body which is attached to the reinforcing ring by integral molding or the like. A technique is known in which a reinforcing ring is further provided with a locking protrusion to be locked by a locking recess provided on a valve stem guide. An example of this technique will be described with reference to FIG. 3. FIG. 3 is a partial breakaway sectional view showing a state during use of a valve stem seal according to a conventional example. Moreover, FIG. 3 shows a vicinity of where the valve stem seal is provided in the intake/exhaust valve mechanism. In addition, FIG. 3 shows a state where a part of a left side of the drawing has been broken away.

The intake/exhaust valve mechanism is provided on a cylinder head 200. In addition, the intake/exhaust valve mechanism includes a valve stem 300, a valve stem guide 400 which guides movement in an axial direction of the valve stem 300, a spring 500 for closing a valve, and a valve stem seal 700 which seals a gap between the valve stem 300 and the valve stem guide 400.

The valve stem seal 700 is constituted by a reinforcing ring 710 made of metal or resin, a seal main body 720 made of an elastic body which is attached to the reinforcing ring 710 by integral molding or the like, and a garter spring 730 which presses the seal main body 720 toward a side of an inner circumferential surface. In addition, the reinforcing ring 710 is provided with a locking protrusion 712 to be locked by a locking recess 410 that is provided on the valve stem guide 400. In this conventional example, as shown, an inverted U-shape slit 711 is provided on the reinforcing ring 710. In addition, the locking protrusion 712 is formed as an inner-side portion of the slit 711 is folded radially inward. A tip of the locking protrusion 712 abuts against a side surface 411 of the locking recess 410 to prevent the reinforcing ring 710 from detaching from the valve stem guide 400.

However, the locking protrusion 712 according to the conventional example does not have sufficient structural strength. Therefore, when pressure inside a sealed space K formed by the valve stem 300, a tip of the valve stem guide 400, and the seal main body 720 rises, there is a risk that the tip of the locking protrusion 712 is pushed forcefully, causing the locking protrusion 712 to break. Accordingly, the seal main body 720 may detach from the tip of the valve stem guide 400 and sealing performance may be impaired.

Furthermore, in another known technique, two slits extending linearly in a circumferential direction are provided on a reinforcing ring and a locking protrusion is provided by folding a portion between the slits radially inward (refer to Patent Literature 1). With this technique, even though strength of the locking protrusion can be enhanced, there is a problem of low workability due to the likelihood of the locking protrusion getting caught by a tip of a valve stem guide when mounting the reinforcing ring to the valve stem guide.

CITATION LIST

Patent Literature

Patent Literature 1: Japanese Examined Utility Model Application Publication No. S47-3215

Patent Literature 2: Japanese Patent Application Laid-open No. H3-37311

Patent Literature 3: Japanese Patent Application Laid-open No. H1-275967

SUMMARY

Technical Problem

An object of the present disclosure is to provide a valve stem seal with superior workability of mounting of a reinforcing ring to a valve stem guide and which enables the reinforcing ring to be fixed to the valve stem guide in a stable manner.

Solution to Problem

In order to solve the problem described above, the present disclosure adopts the following means.

Specifically, a valve stem seal according to the present disclosure is a valve stem seal for sealing a gap between a valve stem and a valve stem guide that guides movement in an axial direction of the valve stem, the valve stem seal including: a reinforcing ring including a cylindrical portion attached to the valve stem guide and an inward flange portion extending radially inward from a tip of the cylindrical portion; and a seal main body that is made of an elastic body and attached to a tip of the inward flange portion and that comes into slidable close contact with an outer circumferential surface of the valve stem, wherein the reinforcing ring is mounted to the valve stem guide by fitting the cylindrical portion to the valve stem guide from a side opposite to the inward flange portion, the cylindrical portion is provided with a slit extending linearly in a circumferential direction and a locking protrusion that is provided on a side opposite to the inward flange portion with respect to the slit and that is to be locked by a locking recess formed in the valve stem guide, and the locking protrusion is constituted by a curved portion that is gradually recessed radially inward from the side opposite to the inward flange portion with respect to the slit to a position that reaches the slit.

According to the present disclosure, the locking protrusion provided on the reinforcing ring is constituted by the curved portion which is gradually recessed radially inward from the side opposite to the inward flange portion to a position that reaches the slit extending linearly in a circumferential direction. Therefore, the strength of the locking protrusion can be enhanced as compared to a locking protrusion that is formed by folding an inner-side portion of a slit with an inverted U-shape radially inward. In addition, when fitting the cylindrical portion to the valve stem guide, since the locking protrusion is deformable so that a slit-side end bends radially outward, workability of mounting of the reinforcing ring is not impaired.

The reinforcing ring may be made of metal, and the locking protrusion may be formed by forming the slit in the cylindrical portion of the reinforcing ring, and then conducting a folding process in which the side opposite to the inward flange portion with respect to the slit is recessed radially inward.

Accordingly, the locking protrusion can be readily formed. Moreover, in the present disclosure, since the slit is shaped so as to extend linearly in the circumferential direction, the slit can be formed more readily as compared to a case of forming a slit with an inverted U-shape. In addition, since only one slit need be formed with respect to one locking protrusion, a number of processing steps is reduced.

Advantageous Effects of the Disclosure

As described above, according to the present disclosure, superior workability of mounting of a reinforcing ring to a valve stem guide is achieved and the reinforcing ring can be fixed to the valve stem guide in a stable manner.

DRAWINGS

DETAILED DESCRIPTION

Hereinafter, modes for implementing the present disclosure will be exemplarily described in detail based on examples thereof with reference to the drawings. However, the dimensions, materials, shapes, relative arrangements and so on of constituent parts described in the examples are not intended to limit the scope of the present disclosure to these alone in particular unless specifically described.

Example

Figure 1:
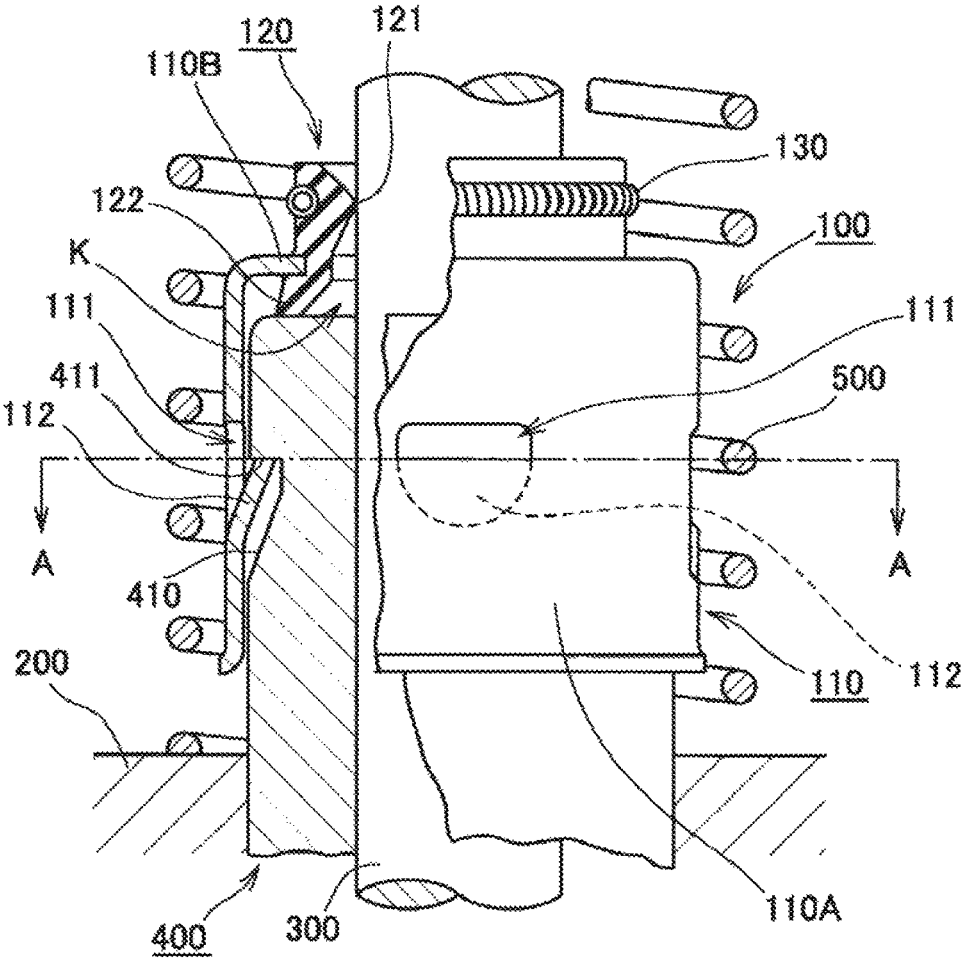
FIG. 1 is a partial breakaway sectional view showing a state during use of a valve stem seal according to an Example of the present disclosure.
Figure 2:
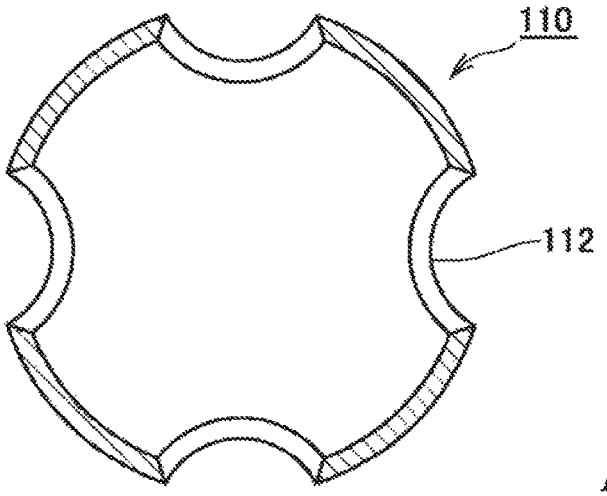
FIG. 2 is a schematic sectional view of a reinforcing ring according to the Example of the present disclosure.
Figure 3:
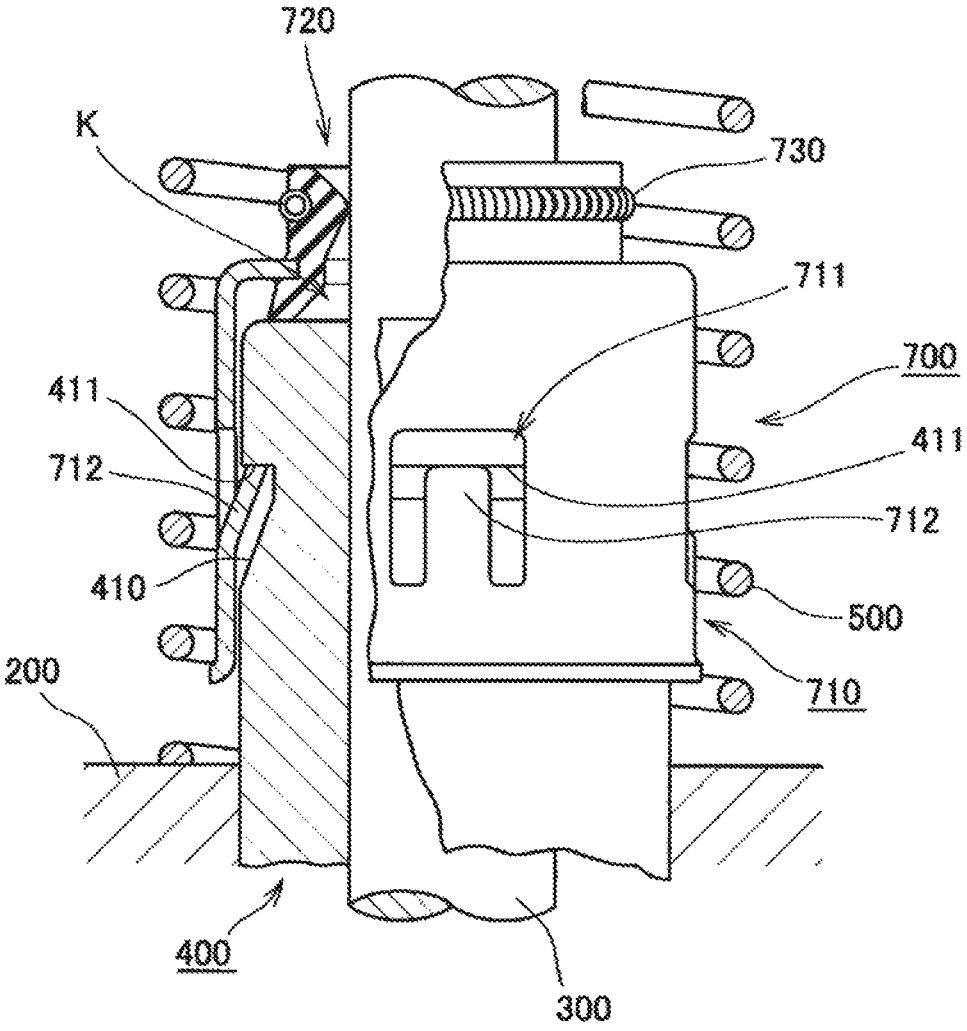
Fig. 3 PRIOR ART
FIG. 3 is a partial breakaway sectional view showing a state during use of a valve stem seal according to a conventional example.

A valve stem seal according to an Example of the present disclosure will be described with reference to FIGS. 1 and 2. FIG. 1 is a partial breakaway sectional view showing a state during use of the valve stem seal according to the Example of the present disclosure. Moreover, FIG. 1 shows a vicinity of where the valve stem seal is provided in an intake/exhaust valve mechanism. In addition, FIG. 1 shows a state where a part of a left side of the drawing has been broken away. FIG. 2 is a schematic sectional view of a reinforcing ring according to the Example of the present disclosure. FIG. 2 corresponds to a sectional view taken along AA of the reinforcing ring shown in FIG. 1.

<Schematic Configuration of Intake/Exhaust Valve Mechanism>

A schematic configuration of the intake/exhaust valve mechanism will now be described with reference to FIG. 1. The intake/exhaust valve mechanism is provided on a cylinder head 200. In addition, the intake/exhaust valve mechanism includes a valve stem 300, a valve stem guide 400 which guides movement in an axial direction of the valve stem 300, a spring 500 for closing a valve, and a valve stem seal 100 which seals a gap between the valve stem 300 and the valve stem guide 400.

The valve stem guide 400 is provided with a locking recess 410 for preventing a reinforcing ring 110 that constitutes the valve stem seal 100 from detaching from the valve stem guide 400. A side surface 411 of the locking recess 410 on an upper side of the drawing is a surface perpendicular to an axial direction. In this case, an "axial direction" refers to a central axial direction of the valve stem 300 (the same description will apply hereinafter).

<Overall Configuration of Valve Stem Seal>

An overall configuration of the valve stem seal 100 will be particularly described with reference to FIG. 1. The valve stem seal 100 is constituted by the reinforcing ring 110 which is made of metal or resin, a seal main body 120 made of an elastic body which is attached to the reinforcing ring 110 by integral molding or the like, and a garter spring 130 which presses the seal main body 120 toward a side of an inner circumferential surface.

The reinforcing ring 110 includes a cylindrical portion 110A attached to the valve stem guide 400 and an inward flange portion 110B extending radially inward from a tip of the cylindrical portion 110A. Moreover, the valve stem guide 400 has a generally cylindrical shape and the cylindrical portion 110A also has a generally cylindrical shape. The reinforcing ring 110 configured as described above is mounted to the valve stem guide 400 by fitting the cylindrical portion 110A to the valve stem guide 400 from a side opposite to the inward flange portion 110B.

The seal main body 120 is attached to a tip of the inward flange portion 110B. In addition, the seal main body 120 includes a first seal lip 121 which comes into slidable close contact with an outer circumferential surface of the valve stem 300 and a second seal lip 122 which comes into close contact with a tip of the valve stem guide 400. Furthermore, due to the garter spring 130 being mounted to an outer circumferential surface of the first seal lip 121, the first seal lip 121 is pressed toward a side of an inner circumferential surface and a state of the first seal lip 121 being in close contact with the outer circumferential surface of the valve stem 300 is maintained.

<Reinforcing Ring>

The reinforcing ring 110 will now be described in greater detail with reference to FIGS. 1 and 2. The cylindrical portion 110A of the reinforcing ring 110 is provided with a slit 111 which extends linearly in a circumferential direction and a locking protrusion 112 which is provided on a side opposite to the inward flange portion 110B with respect to the slit 111. The locking protrusion 112 is configured so as to be locked by a locking recess 410 that is formed on the valve stem guide 400. Moreover, in the present Example, the slit 111 and the locking protrusion 112 are provided at four locations at regular intervals in the circumferential direction.

In addition, the locking protrusion 112 is constituted by a curved portion which is gradually recessed radially inward from the side opposite to the inward flange portion 110B with respect to the slit 111 to a position that reaches the slit 111 (refer to a sectional view of the locking protrusion 112 in FIG. 1). Furthermore, the locking protrusion 112 is curved in an arc shape when viewed in an axial direction (refer to FIG. 2). Accordingly, as shown in the partial cross sectional view of FIG. 1 and the cross sectional view of FIG. 2 the locking protrusion 112 is formed with the slit 111 extending only linearly in a circumferential direction and with no axial slits. In addition, as shown by the dashed line in FIG. 1, the curved portion of the locking protrusion is integrally connected along an entirety of its side edges to the cylindrical portion 110A.

A method of forming the locking protrusion 112 when the reinforcing ring 110 is made of metal will be described. First, the slit 111 which extends linearly in a circumferential direction is formed by a cutting process in the cylindrical portion 110A of the reinforcing ring 110. Subsequently, a folding process is conducted in which the opposite side to the slit 111 with respect to the inward flange portion 110B is recessed radially inward. Accordingly, the locking protrusions 112 can be formed by bending the locking protrusion 112 to define the curved portion in a radially inward direction relative to the cylindrical portion 110A, as illustrated in FIG. 2 while maintaining an integral connection of the sidewalls along the dashed line in FIG. 1 to the cylindrical portion 110A.

When attaching the valve stem seal 100 to the valve stem guide 400, the cylindrical portion 110A of the reinforcing ring 110 is fitted to the valve stem guide 400 from the side opposite to the inward flange portion 110B. In this case, as described above, the locking protrusion 112 is constituted by a curved portion which is gradually recessed radially inward from the side opposite to the inward flange portion 110B with respect to the slit 111 to the position that reaches the slit 111. Therefore, when the cylindrical portion 110A is being fitted to the valve stem guide 400, an end of the locking protrusion 112 on a side of the slit 111 gradually bends radially outward and the end slides on the outer circumferential surface of the valve stem guide 400. Subsequently, concurrently with the end passing the side surface 411 of the locking recess 410, the end is restored to its original shape by its own elastic restoring force. In other words, the end of the locking protrusion 112 on the side of the slit 111 bends radially inward and enters a state where the end penetrates into the locking recess 410. Accordingly, pressure inside a sealed space K rises, and even when a force acts on the reinforcing ring 110 in a direction that causes the reinforcing ring 110 to detach from the valve stem guide 400, the end of the locking protrusion 112 on the side of the slit 111 abuts against the side surface 411 of the locking recess 410 to prevent the reinforcing ring 110 from detaching from the valve stem guide 400. In this case, the sealed space K is formed by the valve stem 300, a tip of the valve stem guide 400, and the seal main body 120.

Advantages of Valve Stem Seal According to Present Example

As described above, with the valve stem seal 100 according to the present Example, the locking protrusion 112 provided on the reinforcing ring 110 is constituted by the curved portion which is gradually recessed radially inward from the side opposite to the inward flange portion 110B to the position that reaches the slit 111 extending linearly in the circumferential direction. Therefore, the strength of the locking protrusion 112 can be enhanced as compared to a locking protrusion that is formed by folding an inner-side portion of a slit with an inverted U-shape radially inward. Accordingly, even when pressure inside the sealed space K rises and the tip of the locking protrusion 112 is forcefully pressed against the side surface 112 of the locking recess 410, damage to the locking protrusion 112 can be suppressed. Therefore, a situation can be prevented where the seal main body 120 detaches from the tip of the valve stem guide 400 and the sealing performance is impaired.

In addition, when fitting the cylindrical portion 110A to the valve stem guide 400, since the locking protrusion is deformable so that the end of the locking protrusion 112 on the side of the slit 111 bends radially outward, workability of mounting of the reinforcing ring 110 is not impaired.

As described above, with the valve stem seal 100 according to the present Example, superior workability of mounting of the reinforcing ring 110 to the valve stem guide 400 is achieved and the reinforcing ring 110 can be fixed to the valve stem guide 400 in a stable manner.

In addition, when the reinforcing ring 110 is made of metal, the locking protrusion 112 can be readily formed by adopting the manufacturing method described earlier. Moreover, in the present Example, since the slit 111 is shaped so as to extend linearly in the circumferential direction, the slit can be formed more readily as compared to a case of forming a slit with an inverted U-shape. Furthermore, since only one slit need be formed with respect to one locking protrusion 112, a number of processing steps can be reduced. Moreover, when the reinforcing ring 110 is composed of resin, the reinforcing ring 110 can be manufactured by die molding. In addition, in this case, the locking protrusion 112 can be provided by providing the slit 111 by a cutting process on a molded article obtained by die molding and subsequently deforming a side opposite to the inward flange portion 110B with respect to the slit 111 radially inward by pressing while applying heat.

REFERENCE SIGNS LIST

100 valve stem seal
110 reinforcing ring
110A cylindrical portion
110B inward flange portion
111 slit
112 locking protrusion
120 seal main body
121 first seal lip
122 second seal lip
130 garter spring
200 cylinder head
300 valve stem
400 valve stem guide
410 locking recess
411 side surface
500 spring
K sealed space

The invention claimed is:

1. A valve stem seal for sealing a gap between a valve stem and a valve stem guide that guides movement in an axial direction of the valve stem, the valve stem seal comprising:

a reinforcing ring including a cylindrical portion attached to the valve stem guide and an inward flange portion extending radially inward from a tip of the cylindrical portion; and a seal main body that is made of an elastic body and attached to a tip of the inward flange portion and that comes into slidable close contact with an outer circumferential surface of the valve stem, wherein the reinforcing ring is mounted to the valve stem guide by fitting the cylindrical portion to the valve stem guide from a side opposite to the inward flange portion, the cylindrical portion is provided with a slit extending only linearly in a circumferential direction with no axial slits and a locking protrusion that is provided on a side opposite to the inward flange portion with respect to the slit and that is to be locked by a locking recess formed in the valve stem guide, and the locking protrusion is constituted by a curved portion that is integrally connected entirely along its side edges to the cylindrical portion and is gradually recessed radially inward from the side edges and a side opposite to the inward flange portion with respect to the slit to a position that reaches the slit.

2. The valve stem seal according to claim 1, wherein the reinforcing ring is made of metal, and the locking protrusion is formed by forming the slit in the cylindrical portion of the reinforcing ring, and then conducting a folding process in which the side opposite to the inward flange portion with respect to the slit is recessed radially inward.

* * * * *